US005245768A

United States Patent [19]

Purkeypile

[11] Patent Number: 5,245,768

[45] Date of Patent: Sep. 21, 1993

[54] BACKFILL SEPARATOR FOR DITCHING MACHINE

[76] Inventor: Doyle Purkeypile, 1401 N. Poplar, Eureka, Kans. 67045

[21] Appl. No.: 737,439

[22] Filed: Jul. 29, 1991

[51] Int. Cl.[5] ..... E02F 5/02

[52] U.S. Cl. ..... 37/347; 37/351; 171/116; 171/134; 209/660

[58] Field of Search ..... 37/80 R, 82, 84, 90; 171/114, 116, 134, 63; 209/393, 660, 664, 667

[56] References Cited

U.S. PATENT DOCUMENTS

| | | | |
|---|---|---|---|
| 163,298 | 5/1875 | Buechley et al. . | |
| 518,982 | 4/1894 | Stuckey et al. . | |
| 1,579,406 | 4/1926 | Skene | 171/116 |
| 1,907,888 | 5/1933 | Spikerman . | |
| 1,920,190 | 8/1933 | Dunkin . | |
| 2,030,587 | 2/1936 | Heaslet . | |
| 2,114,263 | 4/1938 | Heaslet . | |
| 2,649,760 | 8/1953 | Gustafson . | |
| 2,710,097 | 6/1955 | Bolles . | |
| 2,710,466 | 6/1955 | Chartier | 37/90 |
| 2,947,366 | 8/1960 | Orelind et al. | 171/116 |
| 3,010,522 | 11/1961 | Oppel | 171/114 |
| 3,021,621 | 2/1962 | Needham | 37/92 |
| 3,041,750 | 7/1962 | Garnand | 37/92 |
| 3,261,466 | 7/1966 | Holzenthal et al. . | |
| 3,468,417 | 9/1969 | Zollinger . | |
| 3,757,946 | 9/1973 | Berkowitz et al. . | |
| 4,240,902 | 12/1980 | Agee et al. | 209/667 |
| 4,494,611 | 1/1985 | Alvarez . | |
| 4,633,602 | 1/1987 | Layh et al. | 37/142.5 |
| 4,836,388 | 6/1989 | Bielagus | 209/667 |
| 4,972,960 | 11/1990 | Bielagus | 209/667 |
| 5,051,172 | 9/1991 | Gilmore | 209/667 |

FOREIGN PATENT DOCUMENTS

| | | | |
|---|---|---|---|
| 2109993 | 9/1972 | Fed. Rep. of Germany | 37/90 |
| 23801 | 12/1921 | France | 37/90 |
| 550816 | 5/1923 | France | 37/90 |

*Primary Examiner*—Dennis L. Taylor
*Assistant Examiner*—Spencer Warnick
*Attorney, Agent, or Firm*—Shook, Hardy & Bacon

[57] ABSTRACT

A separator is provided for use with a ditching machine to segregate rocks and coarse aggregates from the material excavated by the ditching machine s that the excavated material may be used as padding to protect the pipeline or other item positioned within the excavated trench. The separator comprises a plurality of rows of blades mounted on a rotatable drum. The spacing between adjacent blades within a row allows passage of the fine excavated material between the blades but prevents passage of the rocks and coarse aggregates. The rotating blades then deposit the rocks and coarse aggregates in a row beyond the row of fine material deposited along the trench.

3 Claims, 2 Drawing Sheets

BACKFILL SEPARATOR FOR DITCHING MACHINE

BACKGROUND OF THE INVENTION

This invention relates in general to ditching machines used for digging trenches in which pipelines and cables are buried and, more particularly, to a device for separating rocks from the excavated material.

Ditching machines are widely used to dig extended trenches in which pipelines and other items such as cables are buried. The excavated rock and dirt is typically deposited in a row along one side of the trench and is subsequently used as backfill material once the pipeline has been laid into the trench. During backfilling of the trench, it is important that large objects such as rocks are segregated from the backfill material to prevent damage resulting from such objects falling onto the pipeline. Rocks and similar abrasive items must also be segregated from contact with the buried pipeline to prevent the abrasive action of such objects rubbing against the pipeline during the repeated thermal expansion and contraction experienced by the pipeline.

Padding material in the nature of small aggregates such as sand or crushed caliche is conventionally used to provide a layer of padding surrounding the pipeline to protect it during backfilling operations and from the abrasive action of rocks. Padding material of this type must be continuously transported to the pipeline trench or a large hopper must be provided on the backfilling machine to ensure a constant supply of such material. In either event, transportation of the padding material to the pipeline trench adds significantly to the costs associated with the backfilling operation.

Other types of conventional backfilling machines pick up and process the previously excavated material which has been deposited in a row along the trench to separate the fine material from the coarse aggregates. The fine material is then returned to the trench as padding for the pipeline while the coarse aggregates are replaced in a row alongside the trench. An example of such a machine is disclosed in U.S. Pat. No. 4,633,602. While this type of a machine is desirable because it eliminates the need for transporting padding material from a remote location, its specialized and expensive nature limits its availability for use on many types of projects.

SUMMARY OF THE INVENTION

It is an object of this invention to provide a separator for use on an otherwise conventional ditching machine to separate rocks and coarse material from the excavated material so that the remaining fine material may be used as padding to protect the pipeline or cable placed in the excavated trench.

It is also an object of this invention to provide a ditching machine with separator that operates to segregate the excavated material into a row of fine material placed closest to the trench and a row of coarser material placed beyond the fine material so that a conventional bulldozer or similar bladed equipment may be used to return the fine material to the trench as padding for the pipeline, thereby reducing the operational and equipment costs associated with specialized equipment that would otherwise be required for that purpose.

It is a further object of this invention to provide a ditching machine with a separator that allows padding material to be obtained from the material excavated by the ditching machine so that the expense associated with obtaining and transporting padding material from a remote location to the trench is avoided.

To accomplish these and other related objects of the invention, a separator is provided for segregating large rocks from material excavated by a ditching machine and discharged from a conveyor, said separator comprising:

a frame;

means for coupling the frame with the ditching machine;

a rotatable drum coupled with the frame;

means for rotating said drum; and a plurality of spaced apart blades extending from said drum and rotatable therewith, wherein a spacing between adjacent blades of said plurality of blades permits passage of said material through the spacing but prevents passage of the large rocks, whereby rotation of said blades through said material discharged by the conveyor segregates the large rocks from said material.

BRIEF DESCRIPTION OF THE DRAWING

In the accompanying drawings which form a part of the specification and are to be read in conjunction therewith and in which like reference numerals are used to indicate like parts in the various views.

DESCRIPTION OF THE PREFERRED EMBODIMENT

Figure 1:
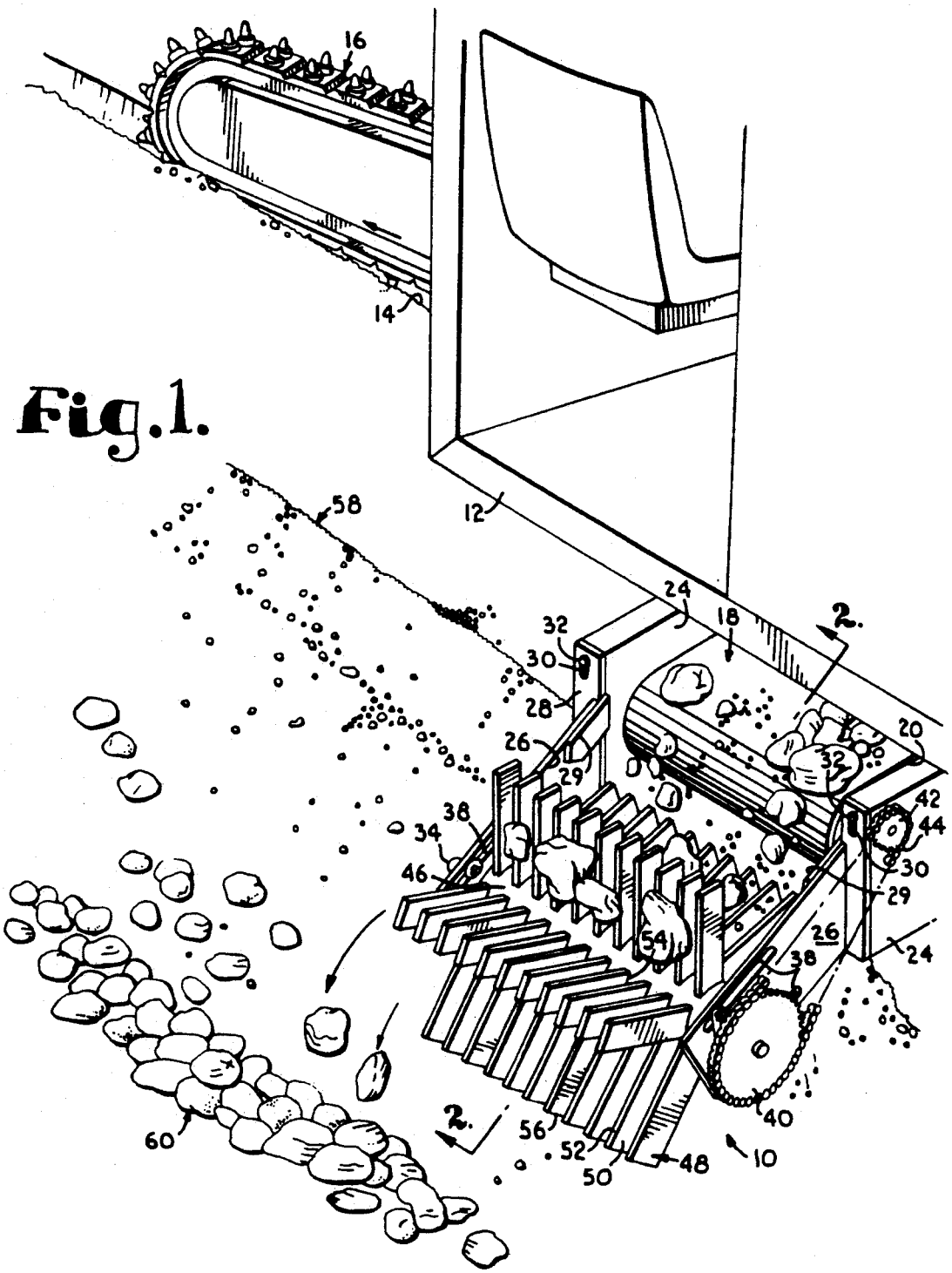
FIG. 1 is a side elevational view showing a separator made in accordance with the present invention coupled with a ditching machine and illustrating operation of the separator to segregate the large rocks from the relatively fine backfill material.

Turning now to the drawings in greater detail and initially to FIG. 1, a separator 10 of the present invention is shown coupled with an otherwise conventional ditching machine 12. Ditching machine 12 is operable to dig an extended trench 14 in which a pipeline or cable may be laid. The ditching machine includes a leading rock saw 16 or other trenching device which digs the trench and transfers the excavated material to a conveyor 18. Conveyor 18 extends perpendicularly to the direction of travel of the machine and rotates in a direction to carry the excavated material from the rock saw 16 and discharge it alongside the trench.

Figure 2:
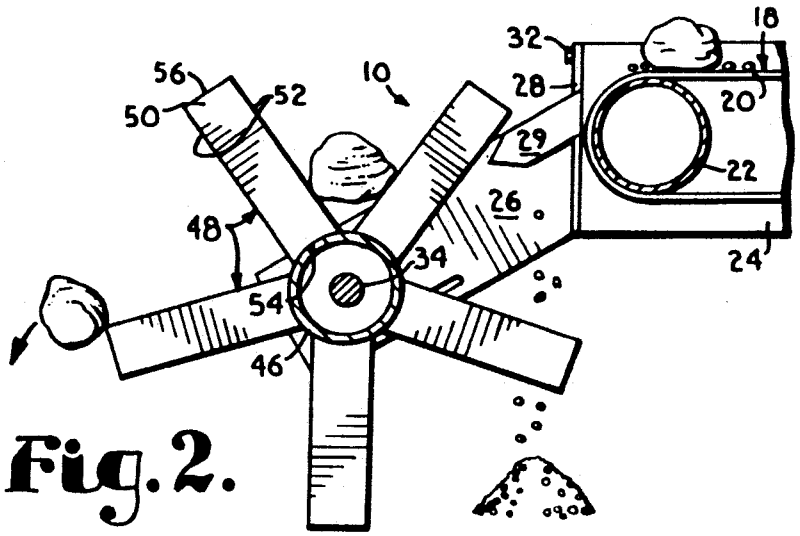
FIG. 2 is a fragmentary side elevational view taken in vertical section along line 2—2 of FIG. 1 and showing the separator and a portion of the ditching machine conveyor.

Turning additionally to FIG. 2, conveyor 18 comprises an endless belt 20 which turns on a shaft mounted roller 22 extending between frame members 24. A similar roller (not shown) is provided to support the other end of the conveyor. Suitable conventional mechanisms are provided to drive the shafts on which the rollers are mounted to effect the desired directional rotation of the conveyor belt 20.

Separator 10 operates to segregate the excavated material conveyed on belt 20 and includes spaced apart frame extensions 26 which are connected to the conveyor frame members 24 by brackets 28 welded to the frame extensions. Reinforcing members 29 are provided to stabilize the connection between the brackets 28 and frame extensions 26. Brackets 28 are provided with slots 30 through which bolts 32 extend to releasably fasten the brackets to the conveyor frame members 24.

Figure 3:
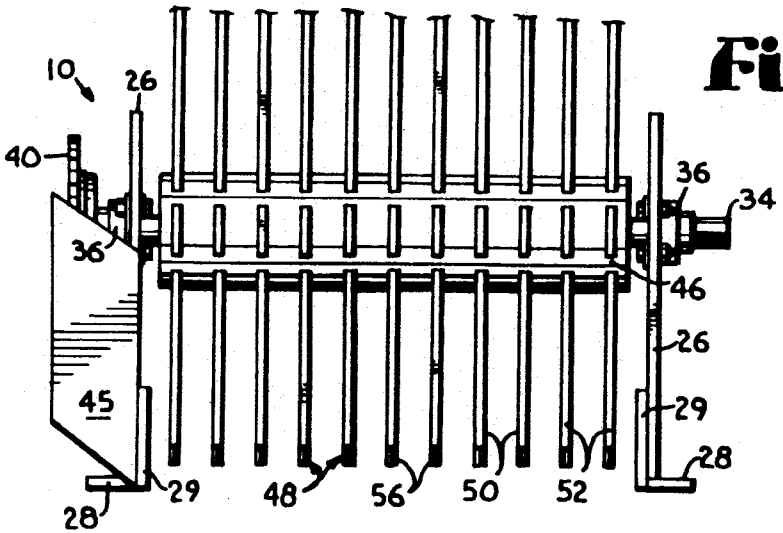
FIG. 3 is a top plan view of the separator with one row of blades shown in fragment.
Figure 4:
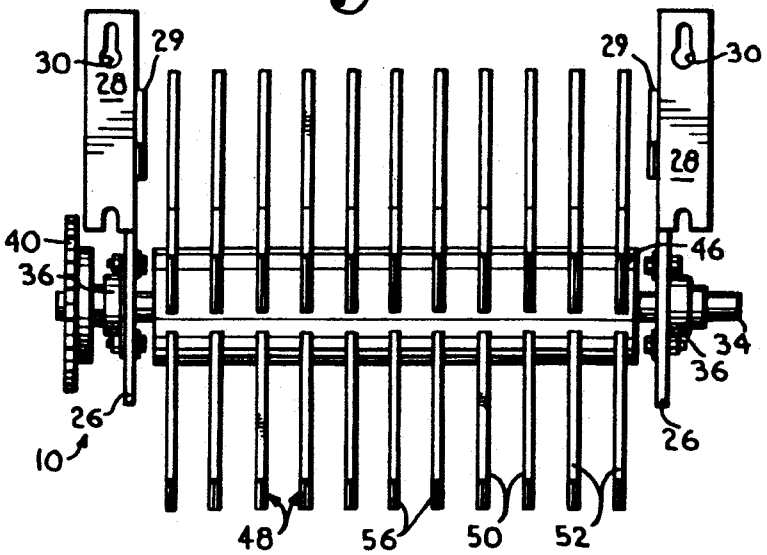
FIG. 4 is a rear elevational view of the separator.

Turning additionally to FIGS. 3–4, a transversely extending shaft 34 extends between and through the frame extensions 26 and is journaled on sealed bearings 36 which are bolted onto the frame extensions. Adjustment slots 38 are provided in the frame extensions for positioning of the shaft 34 in the desired orientation in relation to the conveyor 18. Shaft 34 is provided with a sprocket 40 at one end which is connected to a drive sprocket 42 by a chain 44. Drive sprocket 40 is preferably mounted on the shaft which drives conveyor roller 22, but it may be independently driven. The shaft 34 may also be hydraulically driven if desired. A shield 45 (FIG. 3) is provided to cover and protect the drive mechanism.

A relatively large diameter drum 46 is coaxially mounted on shaft 34 for rotation therewith. The longitudinal length of the drum is preferably equal to or greater than the width of the conveyor belt 20. A plurality of rows of rigid blades 48 are mounted on the drum and extend radially outward therefrom. Each blade 48 has a generally planer rectangular shape and has opposed faces 50, sides 52 and ends 54 and 56. The sides 52 define the long dimension of the blade and extend radially from the drum 46. The distance along blade ends 54 and 56 is considerably less than the length of sides 52 but is substantial enough to impart great directional strength and rigidity to the blade. The blade end 54 has an arcuate shape which conforms to the drum 46 and is welded or otherwise securely affixed to the drum. The blades are positioned on the drum so that a plane defined by either face 50 of each blade lies in the rotational arc of the respective blade. Orientation of the blades in this manner allows them to carry heavy loads without deformation or breakage of the blades or shearing of the blades from their attachment to the drum 46.

The blades are preferably arrayed in five equally spaced rows so that the angle defined by the facing sides 52 of adjacent blades is 72 degrees. The rows are spaced apart so that the sides 52 of blades 48 in adjacent rows are not in contact at the weldment of the blade to drum 46. This spacing provides a wide V-shaped opening between the adjacent rows of blades so that large rocks and similar coarse aggregates may be readily received within the V-shaped opening without becoming lodged therein. Each row extends parallel to the rotation axis of the drum 46 to which the blades are attached so that excavated material is uniformly presented to the blades within any row. The spacing between adjacent blades within a row may be varied as desired to suit particular applications but a spacing of 2" between the faces 50 of adjacent blades has been found to be generally acceptable.

In operation, the separator 10 is positioned on ditching machine 12 so that the rotating blades 48 encounter the excavated material when it is discharged from conveyor 18. As the blades 48 pass through the conveyor discharge, rocks and similar coarse aggregates which are too large to pass through the spacing between adjacent blades within a row are captured by the blades and carried out of the discharge stream by the rotation of the blades. The rocks are then expelled from the blades beyond the discharge stream from the conveyor.

Because of the wide V-shaped opening defined by the rows of blades 48, the rocks do not become lodged within the opening and are easily expelled from the blades by the centrifugal force acting on the rocks. The large diameter drum 46, notably with a 5" outer diameter, and the spacing between rows of blades is particularly important in defining this wide opening and preventing lodgement of the rocks. Frame extensions 26 also aid in segregation of the excavated material by preventing any coarse aggregates from escaping laterally from the rotating blades.

Figure 5:
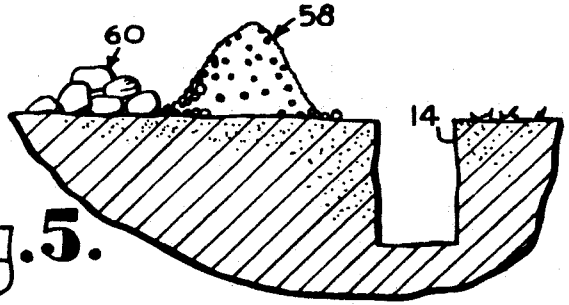
FIG. 5 is a fragmentary elevational view taken in vertical section and showing the trench and the segregated rows of backfill material positioned along the trench.

As can best be seen in FIG. 5, removal of the coarse material from the conveyor discharge allows a row 58 of fine material to be deposited adjacent the trench 14 The rocks and other coarse aggregates which are separated by the rotating blades 48 are placed in a row 60 further from the trench than the row of fine material. Depending upon the rotational velocity of the blades 48, the row of coarse aggregates may be positioned further from or closer to the row of fine material. It has been found that a rotational speed of 70 rpm for the illustrated preferred embodiment of separator 10 is particularly suited for segregation of the coarse aggregates from the fine material.

This segregation of the coarse material by separator 10 allows the row 58 of fine material to be used as padding to protect the pipeline, cable or other item which is placed into the trench 14. A portion of the padding material may be placed into the trench by conventional bladed machinery such as a bulldozer and then the pipeline is positioned atop the padding material in the trench. The remainder of the padding material may then be bladed into the trench to cover and protect the pipeline. The row 60 of coarse aggregates may then be returned to the trench as backfill or may otherwise be disposed of.

It can thus be seen that the separator 10 allows the material excavated by ditching machine 12 to be used as padding material without the need for sophisticated and expensive machinery which would otherwise be required to pick up and process the excavated material to separate the rocks from the fine material. The separator 10 also eliminates the need and expense associated with hauling padding material from a remote location.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A separator for segregating large rocks from finer material, which large rocks and finer material have been excavated by a ditching machine and are being discharged from a conveyor, said separator comprising:

a frame;

means for coupling the frame with the ditching machine;

a rotatable drum coupled with the frame;

means for rotating said drum; and a plurality of spaced apart blades extending from said rum and arranged in five parallel rows which extend along the length of the drum and are parallel to a rotational axis of the drum, said blades having an elongated configuration with a rectangular cross-section, radially inner ends of the blades being rigidly connected to the drum for rotation therewith and to prevent lateral tilting of the blades in a direction along the length of the rows, each of said blades being oriented such that a plane extending along a long dimension of said rectangular cross-section lies within a rotational arc of the associated blade, a spacing between adjacent blades within each of said rows permitting passage of said finer material through the spacing but preventing passage of the large rocks when the blades are rotated through said large rocks and finer material being discharged from the conveyor, wherein said blades and said drum are sized such that said radially inner ends of the blades within each row are spaced apart from said inner ends of blades in adjacent rows.

2. A ditching machine comprising:

a frame;

means coupled with the frame for excavating material comprising large rocks and fines to form an elongated trench as said frame is moved along a generally linear path of travel;

a conveyor coupled with the frame and associated with said excavating means for transporting the excavated material from the excavating means and discharging it along and beside said trench;

a separator positioned to encounter the excavated material as it is being discharged from the conveyor, said separator including a plurality of elongated blades mounted on a rotatable drum and arranged in a plurality of parallel rows, said blades having an elongated configuration with a rectangular cross-section, radially inner ends of the blades being rigidly connected to the drum for rotation therewith and to prevent lateral tilting of the blades in a direction along the length of the rows, each of said blades being oriented such that a plane extending along a long dimension of said rectangular cross-section lies within a rotational arc of the associated blade, a spacing between adjacent blades being sufficient to permit passage of said fines through the spacing but preventing passage of the large rocks, wherein rotation of said blades through said material discharged by the conveyor segregates the large rocks from said fines, said rotatable drum including means operable to rotate the drum at a rotational speed sufficient to expel the large rocks away from the trench and beyond the fines in a direction generally perpendicular to said linear path of travel.

3. The ditching machine of claim 1, wherein said blades are arrayed in five rows, each of said rows extending parallel to a rotational axis of said drum.

* * * * *

UNITED STATES PATENT AND TRADEMARK OFFICE

CERTIFICATE OF CORRECTION

PATENT NO. : 5,245,768

DATED : September 21, 1993

INVENTOR(S) : Doyle Purkeypile

It is certified that error appears in the above-indentified patent and that said Letters Patent is hereby corrected as shown below:

Title page, item [57],
In the third line of the Abstract, "s" should be deleted and --so-- inserted.

Column 4, line 17 of the printed patent, a period should be inserted after "14".

Column 5, line 7 of the printed patent, "rum" should be deleted and --drum-- inserted.

Column 6, line 31 of the printed patent, "1" should be deleted and --2-- inserted.

Signed and Sealed this

Twenty-sixth Day of April, 1994

Bruce Lehman

*Attest:*

BRUCE LEHMAN

*Attesting Officer*

*Commissioner of Patents and Trademarks*